US009653809B2

(12) United States Patent
Chen et al.

(10) Patent No.: US 9,653,809 B2
(45) Date of Patent: May 16, 2017

(54) ANTENNA MODULE AND ANTENNA THEREOF

(71) Applicants: Universal Scientific Industrial (Shanghai) Co., Ltd, Shanghai (CN); Universal Global Scientific Industrial Co., Ltd, Caotun Township, Nantou County (TW)

(72) Inventors: Hsin-Hong Chen, Taichung (TW); Jui-Kun Shih, Caotun Township, Nantou County (TW); Chung-Hsin Chiang, Nantou (TW)

(73) Assignees: Universal Scientific Industrial (Shanghai) Co., Ltd., Shanghai (CN); Universal Global Scientific Industrial Co., Ltd., Caotun Township, Nantou County (TW)

( * ) Notice: Subject to any disclaimer, the term of this patent is extended or adjusted under 35 U.S.C. 154(b) by 173 days.

(21) Appl. No.: 14/064,795

(22) Filed: Oct. 28, 2013

(65) Prior Publication Data

US 2015/0061940 A1 Mar. 5, 2015

(30) Foreign Application Priority Data

Aug. 30, 2013 (TW) ..... 102131364 A

(51) Int. Cl.
*H01Q 9/04* (2006.01)
*H01Q 1/24* (2006.01)

(52) U.S. Cl.
CPC ..... *H01Q 9/0421* (2013.01); *H01Q 1/243* (2013.01)

(58) Field of Classification Search
None
See application file for complete search history.

(56) References Cited

U.S. PATENT DOCUMENTS

| | | | | |
|---|---|---|---|---|
| 6,853,335 | B1 | 2/2005 | Yeh | |
| 7,443,357 | B2 | 10/2008 | Mei | |
| 2004/0056804 | A1* | 3/2004 | Kadambi | H01Q 1/243 343/700 MS |
| 2004/0090377 | A1* | 5/2004 | Dai | H01Q 1/22 343/700 MS |
| 2009/0128416 | A1* | 5/2009 | Cheng | 343/700 MS |
| 2012/0044111 | A1 | 2/2012 | Nagoshi et al. | |

* cited by examiner

*Primary Examiner* — Robert Karacsony
(74) *Attorney, Agent, or Firm* — Muncy, Geissler, Olds & Lowe, P.C.

(57) ABSTRACT

The present invention provides an antenna module and an antenna thereof. The antenna includes a first radiation element, a second radiation element, a third radiation element, and a short-circuit portion. The second radiation element has one end connected with the first radiation element. The third radiation element connected with the other end of the second radiation element, and includes a first connection section, a second connection section, and a third connection section. The first connection section is perpendicular to the second radiation element. The second connection section connected with the first connection section. The third connection section is connected with the second connection section and located at an internal side of the second connection section. The short-circuit portion connected with the second connection section and located at an external side of the second connection portion.

11 Claims, 3 Drawing Sheets

ANTENNA MODULE AND ANTENNA THEREOF

BACKGROUND OF THE INVENTION

1. Field of the Invention

The present invention relates to antenna technology, and more particularly, to an antenna module and an antenna thereof.

2. Description of the Related Art

With the increase of additional functions in handheld communication devices (such as, smart phone, digital camera, tablet computer and PDA, etc.), circuit modules corresponding to these additional functions are compressed into a small size that can be placed in a predetermined configuration space (the inside of a handheld communication device). Thus, miniaturization has become the important developing of circuit modules.

Following the aforesaid trend toward miniaturization in circuit module technology, antenna modules for handheld communication products must be small-sized. To reduce the size of an antenna module, it is normally to limit the configuration space of the antenna module at first, and then to design the antenna size and the antenna drive circuit subject to the limited configuration space. However, whether the drive circuit can be narrowed or not depends on the allocation of the integrated circuit and the related components. However, this point is not the technical content to be improved in the present invention, and it will not be discussed here.

Inverted-L antennas and inverted-F antennas are widely used at the present time. U.S. Pat. No. 6,853,335 disclosed an inverted-L antenna. U.S. Pat. No. 7,443,357 disclosed an inverted-F antenna. The signal feed in direction in the inverted-F antenna of US20120044111 is kept in parallel to the ground element. This is the commonly adopted technique. However, this conventional arrangement does not allow the dimension of the ground element to be significantly reduced. Reducing the dimension will cause the ground element to lose its inductance characteristic, leading to antenna operation failure at the operating frequency. Therefore, when an antenna works at the operating frequency of 2.4G, the antenna configuration If the operating frequency is set at 2.4G, the size of an inverted-F antenna configured subject to conventional technique will be constrained by the limit of the overall size of the ground element and main radiation element.

Further, because the radiating elements have the same line width, a magnetic flux leakage can occur at every turning corner of each radiating element, affecting the performance of the antenna.

Further, a conventional antenna module generally provides an electrical connector for connection with the ground plane of the main board of a handheld communication product. However, the pins of the electrical connector have a specific length and cannot be shortened. Thus, during a high-frequency application, the pins can induce an extra inductance effect, causing the impedance of the antenna unable to obtain optimal impedance matching.

SUMMARY OF THE INVENTION

The present invention has been accomplished under the circumstances in view. It is the main object of the present invention to provide an antenna module and an antenna thereof, which keeps the feeding signal inputting direction and outputting direction in a perpendicular relationship, obtaining optimal antenna arrangement and minimizing the size of the antenna.

To achieve this and other objects of the present invention, an antenna of the invention comprises a first radiation element, a second radiation element, a third radiation element and a short-circuit portion. The second radiation element has one end thereof connected with the first radiation element. The third radiation element comprises a first connection section, a second connection section and a third connection section. The first connection section has one end thereof connected with an opposite end of the second radiation element. The first connection section and the second radiation element are kept perpendicular to each other. The second connection section has one end thereof connected with an opposite end of the first connection section. The third connection section is connected with the second connection section and located at an internal side of the second connection section and abutted against an opposite end of the second connection section. The short-circuit portion has an opposite end thereof connected with the second connection section of the third radiation element and located at an external side of the second connection section.

Further, an antenna module of the present invention comprises a substrate and an antenna. The substrate comprises a top surface, a bottom surface, a ground plane and a plurality of contacts. The ground plane is disposed within the substrate. The contacts are connected to the ground plane and located at the bottom surface. The antenna is formed on the top surface of the substrate, comprising a first radiation element, a second radiation element, a third radiation element, a short-circuit portion and a transmission unit. The second radiation element has one end thereof connected with the first radiation element. The third radiation element comprises a first connection section, a second connection section and a third connection section. The first connection section has one end thereof connected with an opposite end of the second radiation element. The first connection section and the second radiation element are kept perpendicular to each other. The second connection section has one end thereof connected with an opposite end of the first connection section. The third connection section is connected with the second connection section and located at an internal side of the second connection section and abutted against an opposite end of the second connection section. The short-circuit portion has one end thereof connected with the second connection section of the third radiation element and located at an external side of the second connection section. The short-circuit portion has an opposite end thereof connected with the ground plane. The transmission unit comprises a feeding impedance. The transmission unit has one end thereof connected with the third connection section of the third radiation element, and an opposite end thereof adapted for receiving a feeding signal. The line width of the transmission unit is equal to the line width of the third connection section. Thus, the antenna module does not need an electrical connector, and can maintain the antenna in a predetermined matching impedance.

Other and further benefits, advantages and features of the present invention will be understood by reference to the following specification in conjunction with the accompanying drawings, in which like reference characters denote like elements of structure.

DETAILED DESCRIPTION OF THE INVENTION

To clearly illustrate the technical features of the present invention, the size of the antenna in accordance with the preferred embodiment of present invention is based on the operating frequency of 2.4 GHz. In practice, however, the antenna varies in size subject to change of the operating frequency, for example, the antenna dimension will be relatively smaller than the preferred embodiment if it operates around 60 GHz, therefore, the antenna of the present invention is not limited to the operating frequency of 2.4 GHz.

Figure 1:
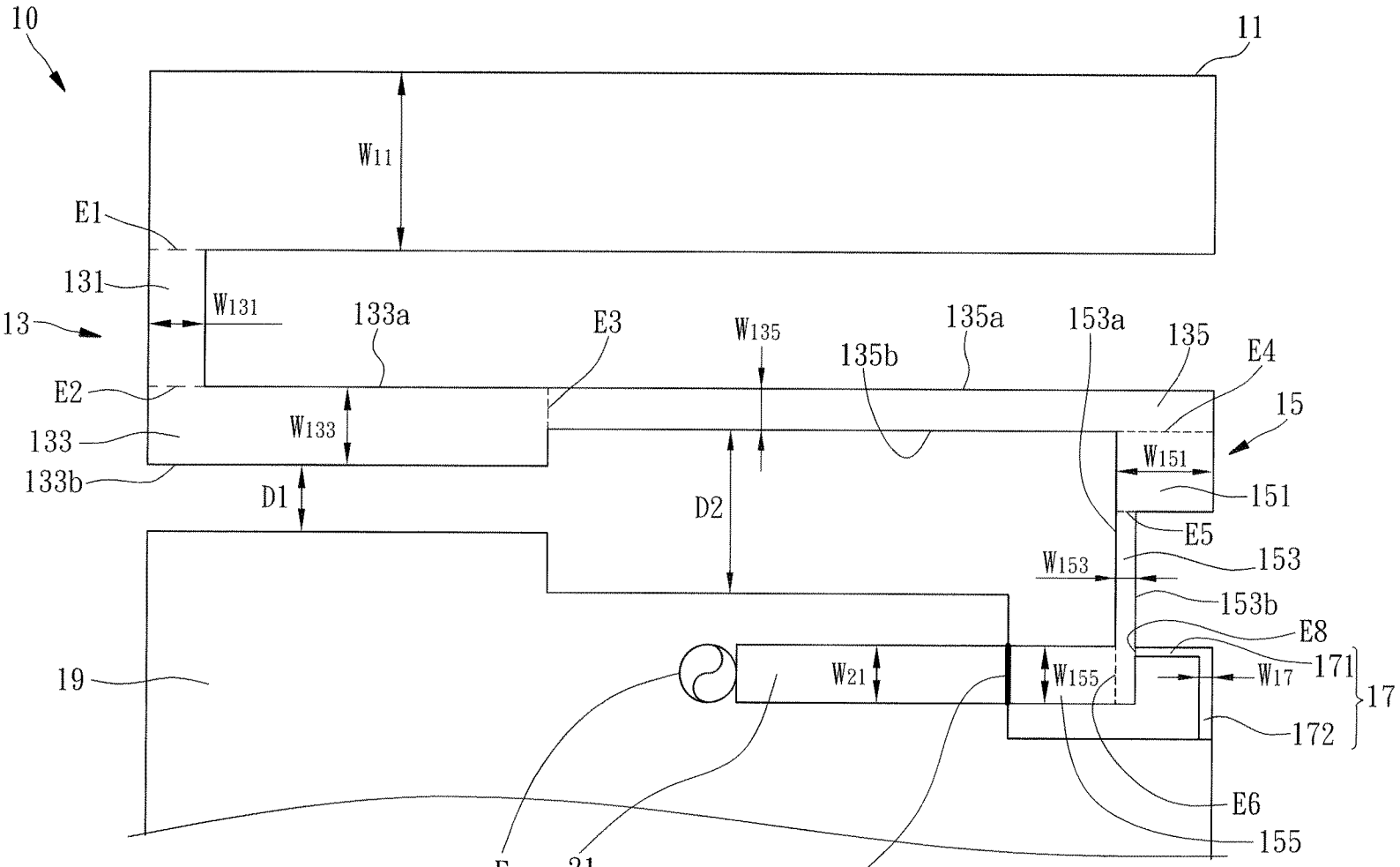
FIG. 1 is a schematic drawing illustrating an antenna in accordance with the present invention.

Referring to FIG. 1, an antenna in accordance with the present invention is shown. The antenna 10 is a one-piece member, comprising a first radiation element 11 a second radiation element 13, a third radiation element 15, a short-circuit portion 17, a grounding plane 19 and a transmission unit 21. In order to clearly illustrate the technical features of the present invention, broken lines are used to divide the radiation elements, however, these broken lines actually do not exist in the antenna.

The line width $W_{11}$ of the first radiation element 11 is adapted for controlling the available bandwidth of the antenna, i.e., the line width $W_{11}$ of the first radiation element 11 is adjustable subject to the needed bandwidth design.

The second radiation element 13 comprises a vertical section 131, a first coupling section 133, and a second coupling section 135. The vertical section 131 has one end thereof connected with the first radiation element 11, as illustrated by the broken line E1, and an opposite end thereof connected with one end of the first coupling section 133, as illustrated by the broken line E2. The vertical section 131 implies a vertical relationship with the first radiation element 11 and the first coupling section 133. The second coupling section 135 has one end thereof connected with an opposite end of the first coupling section 133, as illustrated by the broken line E3. The first coupling section 133 and the second coupling section 135 have a respective top side thereof 133*a*;135*a* facing toward the first radiation element 11 and kept in parallel to the first radiation element 11.

The line width $W_{131}$ of the vertical section 131 is equal to the line width $W_{133}$ of the first coupling section 133. The line width $W_{135}$ of the second coupling section 135 is smaller than the line width $W_{133}$ of the first coupling section 133.

The third radiation element 15 comprises a first connection section 151, a second connection section 153, and a third connection section 155. The first connection section 151 is kept perpendicular to the second coupling section 135 of the second radiation element 13. The first connection section 151 has one end thereof connected with the second coupling section 135, as illustrated by the broken line E4. The first connection section 151 is located at a bottom side 135*b* of the second coupling section 135 and abutted against an opposite end of the second coupling section 135. The second connection section 153 has one end thereof connected with an opposite end of the first connection section 151, as illustrated by the broken line E5. The third connection section 155 has one end thereof connected with the second connection section 153, as illustrated by the broken line E6. The third connection section 155 is located at an internal side 153*a* of the second connection section 153, abutting against an opposite end of the second connection section 153. The third connection section 155 has an opposite end thereof connected with one end of the transmission unit 21, as illustrated by the solid line E7. The transmission unit 21 has an opposite end thereof adapted for receiving a feeding signal F. The transmission unit 21 has a feeding impedance. This feeding impedance is constant, and can be designed by any person skilled in the art using the theory of microstrip transmission lines, or adjusted by a passive component (such as resistor). Thus, when a different feeding impedance is needed, either of the aforesaid two methods can be selectively employed to design the transmission unit 21. As illustrated, the first radiation element 11 and the third radiation element 15 are respectively connected with the two opposite ends of the radiation element 13.

The line width $W_{21}$ of the transmission unit 21 is equal to the line width $W_{155}$ of the third connection section 155. Because the transmission unit 21 and the third connection section 155 have the same width, the feeding signal F fed through the transmission unit 21 into the third connection section 155 is a continuous signal, and its direction is constant.

The line width $W_{151}$ of the first connection section 151 is preferably within the range of 1.5 to 3 times over the line width $W_{135}$ of the second coupling section 135. In this embodiment, the line width $W_{151}$ of the first connection section 151 is 2 times over the line width $W_{135}$ of the second coupling section 135 so that the converted magnetic flux of the feeding signal F can completely and smoothly flow to the second coupling section 135, reducing magnetic flux leakage. Generally speaking, the phenomenon of magnetic flux leakage is a magnetic flux loss that is caused due to that the magnetic flux cannot fully pass a curved area in the antenna.

In this embodiment, the line width $W_{153}$ of the second connection section 153 and the line width $W_{135}$ of the second coupling section 135 are preferably configured within the range of 0.1-0.4 mm. In actual practice, the line width $W_{153}$ of the second connection section 153 is determined subject to the current level of the feeding signal F.

The short-circuit 17 located at an external side 153*b* of the second connection section 153 of said third radiation element 15. The short-circuit 17 having a first segment 171 and a second segment 172. The first segment 171 of the short-circuit 17 connected with the second connection section 153, as illustrated by broken line E8, The first segment 171 of the short-circuit 17 kept perpendicular relative to the second connection section 153. The second segment 172 has one end thereof connected with the first segment 171. The second segment 172 kept perpendicular relative to the first segment 171. The second segment 172 of the short-circuit 17 has an opposite end thereof connected with the ground plane 19.

Further, a first predetermined distance D1 is defined between the ground plane 19 and a bottom side 133*b* of the first coupling section 133; a second predetermined distance D2 is defined between the ground plane 19 and a bottom side 135*b* of the second coupling section 135. The first predetermined distance D1 is smaller than the second predetermined distance D2. The first predetermined distance D1 and the second predetermined distance D2 are adapted for adjusting the effect of capacitance of the antenna 10.

Adjustment of the line width $W_{17}$ of the short-circuit portion 17 determines the effect of inductance of the antenna 10. Thus, by means of adjusting the first predetermined distance D1, the second determined distance D2 and the line width $W_{17}$ of the short-circuit portion 17, the impedance of the antenna 10 can be determined and can match the feeding impedance.

In this embodiment, the line width $W_{17}$ of the short-circuit portion 17 is 0.1 mm, however, in actual practice, increasing the effect of inductance can be achieved by reducing the line width $W_{17}$ to a level below 0.1 mm. Further, reducing the effect of inductance can be achieved by increasing the line width $W_{17}$ to a level above 0.1 mm. Preferably, the optimal line width $W_{17}$ of the short-circuit portion 17 is equal or smaller than 0.25 mm.

Further, to increase the effect of capacitance can choose to shorten the first predetermined distance D1. Similarly, to reduce the effect of capacitance can choose to increase the first predetermined distance D1. Thus, the line width $W_{17}$ of the short-circuit portion 17, the first predetermined distance D1 and the second predetermined distance D2 are adjustable subject to the feeding impedance.

When compared to prior art techniques, the size of the antenna of the invention can be miniaturized by selecting the optimal feeding location, i.e., the optimal structural arrangement of the third connection section 155 of the third radiation element 15 and the short-circulation portion 17, to keep the flow direction of the feeding signal passing through the third connection section 155 in a perpendicular relationship with the flow direction of the feeding signal pass through the short-circuit portion 17 into the ground plane 19.

Figure 2:
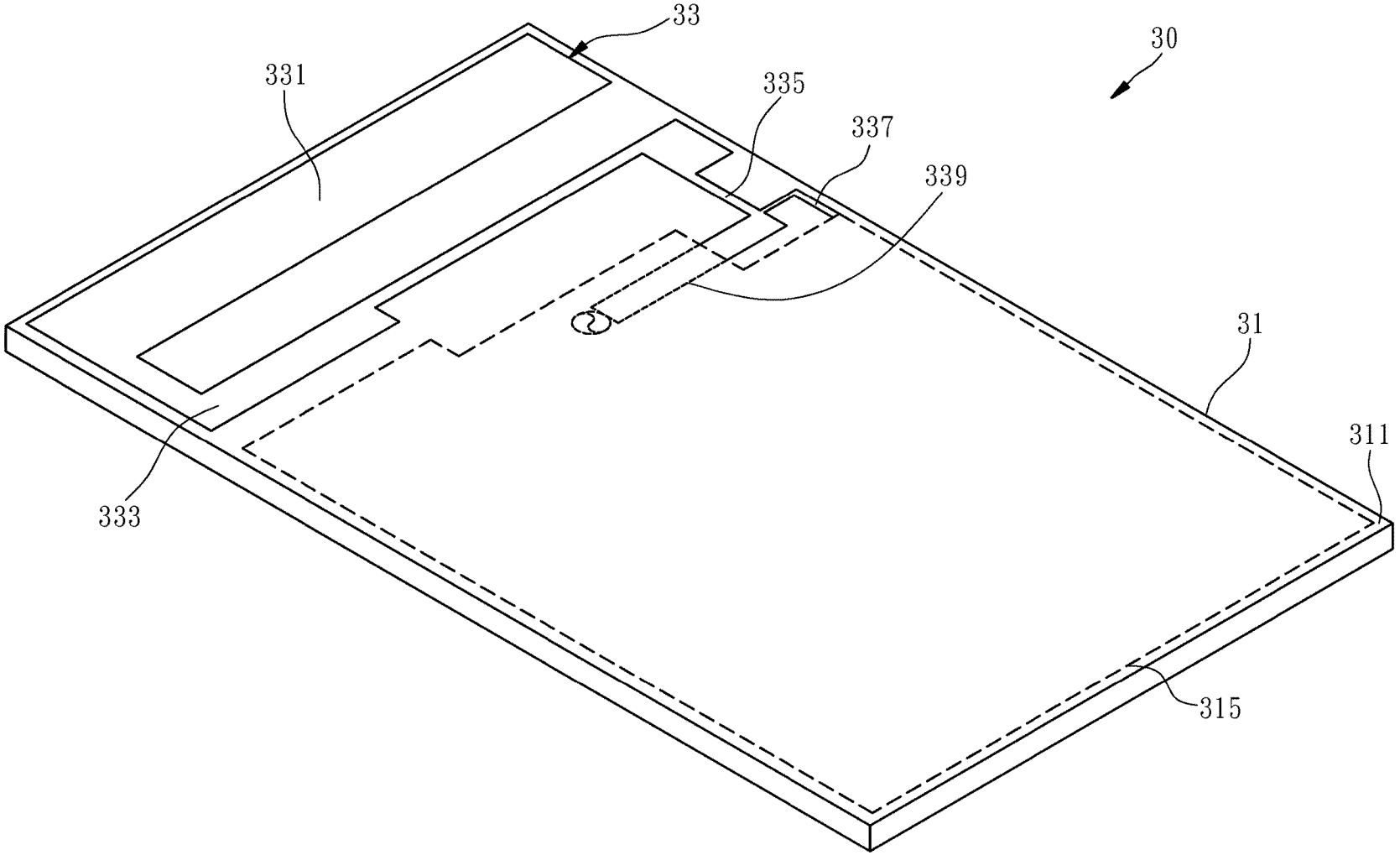
FIG. 2 is a schematic perspective view of an antenna module in accordance with the present invention.
Figure 3:
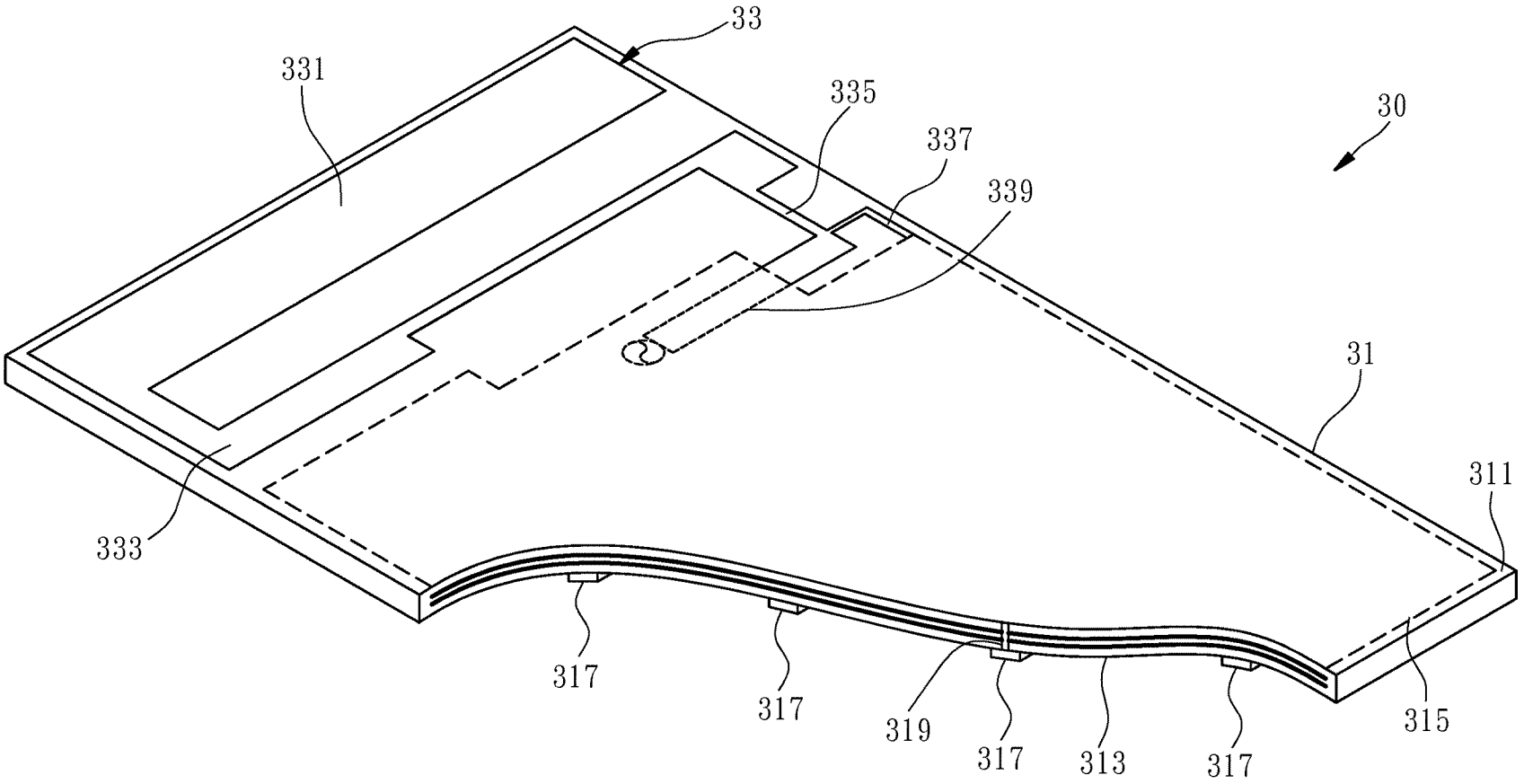
FIG. 3 is a schematic sectional elevational view of the antenna module in accordance with the present invention.

Referring to FIGS. 2 and 3, an antenna module 30 in accordance with the present invention comprises a substrate 31 and an antenna 33. The substrate 31 can be a printed circuit board or flexible printed circuit board, comprising a top surface 311, a bottom surface 313, a ground plane 315 and a plurality of contacts 317. Further, in actual application, the substrate 31 can be made in a single layer or multi-layer design. The ground plane 315 is disposed within the substrate 31. The contacts 317 are connected with the ground plane 315 and located at the bottom surface 313 of the substrate 31. These contacts 317 can be solder pads or solder balls respectively connected to the ground plane 315 by a respective via 319. The antenna 33 is formed on the top surface 311 of the substrate 31. Preferably, printing or etching technique is employed to make the antenna 33. The function and advantages of this antenna 33 are same as the aforesaid antenna 10. Thus, no further detailed description in this regard will be given. Further, the short-circuit portion 337 of the antenna 33 can be electrically connected to the ground plane 315 by a via (not shown).

It is to be noted that the first radiation element 331, second radiation element 333, third radiation element 335 and short-circuit portion 337 of the antenna 33 are exposed to the outside of the top surface 311 of the substrate 31; the transmission unit 339 and the ground plane 315 are covered by an insulating layer. Because the transmission unit 339 and the ground plane 315 are covered by an insulating layer, the transmission unit 339 and the ground plane 315 are indicated by broken lines. Further, there is no connection between the transmission unit 339 and the ground plane 315.

Thus, when the antenna module 30 is installed in a main board of a handheld device (not shown), the contacts 317 of the antenna module 30 are directly electrically connected to the ground plane of the main board, forming a relatively larger ground reference plane. Further, the antenna module 30 does not need a conventional electrical connector, reducing the overall size and shortening the connection distance between the antenna module and the main board for enabling the antenna module 30 to be operated at a predetermined operating frequency.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An antenna, comprising:

a first radiation element;

a second radiation element having one end thereof connected with said first radiation element, said second radiation element comprising a vertical section, a first coupling section and a second coupling section, said vertical section having two opposite ends thereof respectively connected with said first radiation element and said first coupling section in a perpendicular manner relative to said first radiation element and said first coupling section, said second coupling section having one end thereof connected with said first coupling section, said first coupling section and said second coupling section having a respective top side thereof spaced from and facing toward said first radiation element;

a third radiation element comprising a first connection section, a second connection section and a third connection section, said first connection section having one end thereof connected with an opposite end of said second radiation element, said first connection section being kept perpendicular relative to said second radiation element, said second connection section having one end thereof connected with an opposite end of said first connection section, said third connection section being connected with said second connection section and located at an internal side of said second connection section and abutted against an opposite end of said second connection section, said third connection section being received a feeding signal, wherein a line width of said first connection section is about 1.5 to 3 times over the line width of said second coupling section;

a short-circuit portion located at an external side of said second connection section of said third radiation element, and having a first segment and a second segment, said first segment connected with said second connection section, and kept perpendicular relative to said second connection section, said second segment connected with said first segment, and kept perpendicular relative to said first segment; and a ground plane connected with said second segment of said short-circuit portion.

2. The antenna as claimed in claim 1, wherein said short-circuit portion has a line width equal or smaller than 0.25 mm.

3. The antenna as claimed in claim 1, said ground plane defining with said second radiation element a first predetermined distance and a second predetermined distance therebetween, the first predetermined distance being shorter than said second predetermined.

4. The antenna as claimed in claim 3, wherein said first predetermined distance is defined between said ground plane and a bottom side of said first coupling section; said second predetermined distance is defined between said ground plane and a bottom side of said second coupling section.

5. The antenna as claimed in claim 1, further comprising a transmission unit, said transmission unit comprising a feeding impedance, said transmission unit having one end thereof connected with said third connection section of said third radiation element and an opposite end thereof adapted for receiving a feeding signal, the line width of said transmission unit being equal to the line width of said third connection section.

6. The antenna as claimed in claim 5, wherein the flow direction of said feeding signal through said third connection section has a perpendicular relationship with the flow direction of said feeding signal through said short-circuit portion into said ground plane.

7. An antenna module, comprising:

a substrate comprising a top surface, a bottom surface, a ground plane and a plurality of contacts, said ground plane being located at said top surface of said substrate, said contacts being electrically connected to said ground plane and located at said bottom surface; and an antenna formed on said top surface of said substrate, said antenna comprising a first radiation element, a second radiation element, a third radiation element, a short-circuit portion and a transmission unit, said second radiation element having one end thereof connected with said first radiation element, said third radiation element comprising a first connection section, a second connection section and a third connection section, said first connection section having one end thereof connected with an opposite end of said second radiation element, said first connection section being kept perpendicular to said second radiation element, said second connection section having one end thereof connected with an opposite end of said first connection section, said third connection section being connected with said second connection section and located at an internal side of said second connection section and abutted against an opposite end of said second connection section, said short-circuit portion located at an external side of said second connection section of said third radiation element, and having a first segment and a second segment, said first segment connected with said second connection section, and kept perpendicular relative to said second connection section, said second segment connected with said first segment and said ground plane, and kept perpendicular relative to said first segment, said transmission unit comprising a feeding impedance, said transmission unit having one end thereof connected with said third connection section of said third radiation element and an opposite end thereof adapted for receiving a feeding signal, the line width of said transmission unit being equal to the line width of said third connection section, wherein said second radiation element comprises a vertical section, a first coupling section and a second coupling section, said vertical section having two opposite ends thereof respectively connected with said first radiation element and said first coupling section in a perpendicular manner relative to said first radiation element and said first coupling section, said second coupling section having one end thereof connected with said first coupling section, said first coupling section and said second coupling section having a respective top side thereof spaced from and facing toward said first radiation element and wherein the line width of said first connection section is about 1.5 to 3 times over the line width of said second coupling section.

8. The antenna module as claimed in claim 7, wherein said short-circuit portion has a line width equal or smaller than 0.25 mm.

9. The antenna module as claimed in claim 7, wherein said ground plane defines with said second radiation element a first predetermined distance and a second predetermined distance therebetween, said first predetermined distance being shorter than said second predetermined distance.

10. The antenna module as claimed in claim 9, wherein said first predetermined distance is defined between said ground plane and a bottom side of said first coupling section; said second predetermined distance is defined between said ground plane and a bottom side of said second coupling section.

11. The antenna module as claimed in claim 7, wherein the flow direction of said feeding signal through said third connection section has a perpendicular relationship with the flow direction of said feeding signal through said short-circuit portion into said ground plane.

* * * * *